US006241421B1

(12) United States Patent
Harvie et al.

(10) Patent No.: US 6,241,421 B1
(45) Date of Patent: Jun. 5, 2001

(54) SUBTERRANEAN DRAIN ASSEMBLY

(75) Inventors: Wilson Harvie; Thomas M. van der Meulen, both of Snellville, GA (US)

(73) Assignee: Royal Ten Cate (USA), Inc., Norcross, GA (US)

( * ) Notice: Subject to any disclaimer, the term of this patent is extended or adjusted under 35 U.S.C. 154(b) by 0 days.

(21) Appl. No.: 09/291,517

(22) Filed: Apr. 14, 1999

Related U.S. Application Data

(60) Provisional application No. 60/107,496, filed on Nov. 6, 1998.

(51) Int. Cl.[7] ..... E02B 11/00

(52) U.S. Cl. ..... 405/45; 405/43; 405/50; 405/36; 52/169.5

(58) Field of Search ..... 52/169.5; 405/43, 405/45, 50, 36

(56) References Cited

U.S. PATENT DOCUMENTS

| | | | | |
|---|---|---|---|---|
| 3,445,322 | | 5/1969 | Saiia et al. | 161/113 |
| 3,561,177 | * | 2/1971 | Agro et al. | 52/169.14 |
| 3,654,765 | | 4/1972 | Healy et al. | 61/11 |
| 3,888,087 | * | 6/1975 | Bergsland | 61/11 |
| 4,490,072 | | 12/1984 | Glasser | 405/45 |
| 4,572,700 | | 2/1986 | Mantarro et al. | 404/35 |
| 4,574,541 | | 3/1986 | Raidt et al. | 52/169.5 |
| 4,639,165 | | 1/1987 | Flecknoe-Brown | 405/45 |
| 4,704,048 | | 11/1987 | Ahlgrimm | 405/45 |
| 4,730,953 | | 3/1988 | Tarko | 405/45 |
| 4,733,989 | | 3/1988 | Harriett | 405/43 |
| 4,745,716 | | 5/1988 | Kuypers | 52/169.5 |
| 4,749,306 | | 6/1988 | Demeny et al. | 405/45 |
| 4,756,643 | | 7/1988 | Hurley | 405/36 |
| 4,840,515 | | 6/1989 | Freese | 405/45 |
| 4,880,333 | | 11/1989 | Glasser et al. | 405/43 |
| 4,897,313 | | 1/1990 | Wiercinski | 428/489 |
| 4,943,185 | | 7/1990 | McGuckin et al. | 405/45 |
| 4,956,951 | | 9/1990 | Kannankeril | 52/169.5 |
| 5,044,821 | | 9/1991 | Johnsen | 405/50 |
| 5,056,281 | | 10/1991 | McCarthy | 52/169 |
| 5,067,798 | | 11/1991 | Tomoyasu | 359/286 |

(List continued on next page.)

FOREIGN PATENT DOCUMENTS

| | | |
|---|---|---|
| 0 307 541 | 3/1989 | (EP) . |
| 0 499 442 | 8/1992 | (EP) . |
| WO 91/10782 | 7/1991 | (WO) . |

OTHER PUBLICATIONS

QuickDRAIN Product Data Sheet, published by TC MiraDRI, MiraDRI Moisture Protection Products, Norcorss, Georgia (04/98).*

(List continued on next page.)

*Primary Examiner*—Thomas B. Will
*Assistant Examiner*—Alexandra K. Pechhold
(74) *Attorney, Agent, or Firm*—John S. Pratt; Kyle M. Globerman; Kilpatrick Stockton LLP

(57) ABSTRACT

A drainage assembly is disclosed for draining water from the vicinity of a subterranean construction surface, such as a subgrade foundation wall. The assembly comprises a hollow drainage panel formed by a sheet-like base and a filter media, the filter media being spaced apart from the base by a plurality of members that project from the inner surface of the base. The base has at least one hinge, and preferably two closely spaced parallel hinges, extending along its entire length between adjacent side edges, thereby allowing the panel to be easily folded and set into place against a foundation, with the portion above the hinge resting against the vertical foundation wall and the portion below the hinge resting atop the foundtion's horizontal footing. The apparatus further comprises a connector assembly that connects the panel to a standard drain pipe to convey water away from the foundation.

2 Claims, 4 Drawing Sheets

U.S. PATENT DOCUMENTS

| | | | |
|---|---|---|---|
| 5,154,029 | 10/1992 | Sturgeon | 52/235 |
| 5,167,579 | 12/1992 | Rotter | 454/365 |
| 5,383,314 | 1/1995 | Rothberg | 52/169 |
| 5,444,950 | 8/1995 | Kelly et al. | 52/169 |
| 5,489,462 | 2/1996 | Sieber | 428/174 |
| 5,630,299 | 5/1997 | Jackman et al. | 52/169.5 |
| 5,794,388 | 8/1998 | Jackman | 52/169.5 |

OTHER PUBLICATIONS

"COBRA® Ridge Vent Strikes Out Against Poor Attic Ventilation!" Technical Specifications of GAF Materials Corporation, no date available.

"COR–A–VENT The Ridge Vent for all Applications," COR–A–VENT, Inc., Mishaaka, Indiana, no date available.

AB7–1195–10P, AMERDRAIN® Prefabricated Plastic Soil Sheet Drain and TOTAL–DRAIN™ System brochure, published by American Wick Drain Corporation.

AMERDRAIN® Total–Drain™ Soil Sheet Drain System, published by American Wick Drain Corporation, Matthews, North Carolina, no date available.

CAT–DRAIN–0898, "The Evolution of Rock is on a Roll—Introducing MiraDRAIN: the Next Genreation and QuickDrain," published by TC MiraDRI, Norcross, Georgia.

CAT–MDRAIN–696, MIRADRAIN Prefabricated Drainage Composites product brochure, published by Mirafi Mostrure Protection, a division of Royal Ten Cate (USA), Inc.

CAT–MDRI860–596, MIRADRI® 860/861 product brochure, published by Miradfi Mosture Protection, a division of Royal Ten Cate (USA), Inc.

CAT–MMP–396, Catalog of Single Source System Solutions, published by Mirafi Moisture Protection Products, Norcross, Georgia.

CAT–SWWPB–0198, MiraDRI Moisture Protection Products catalog, published by TC MiraDri, Norcross, Georgia.

CCW–Total–Drain Drainage System, published by Carlisle Coating & Waterproofing, no date available.

CS–D7Boston–795, A Case Study of Boston Common Parking Garage Project, published by MIRAFI Moisture Protection Products, Norcross, Georgia.

CS–Embssysuit–296, A Case Study of Embasy Suites Hotel, published by Mirafi Moisture Protections, Norcross, Georgia.

CS–Hartford–296, A Case Study of Hartford Hospital, published by Miradfi Moisture Protection, Norcross, Georgia.

CS–Olympicstad–296, A Case Study of Atlanta Centennial Olympic Stadium, published by Mirafi Moisture Protection, Norcross, Georgia.

DD–MDRAIN–495, Drainage Details of MIRADRAIN®, published by Mirafi Moisture Protection Products, Norcross, Georgia.

DWP–MDRI/DRAIN–495, Waterproofing Details of MIRADRI® 860/861, published by Mirafi Moisture Protection Products, Norcross, Georgia.

PDS–700–394, Product Description of MIRADRI™ 700 Self–Adhered Waterproofing Membrane for Bridges and Parking Decks, published by Nicolon Mirafi Group, Norcross, Georgia.

PDS–AWP–495, Product description of MIRADRI® All Weather Primer, published by Nicolon Mirafi Group, Norcross, Georgia.

PDS–MDRI860/861–595, Product Description of MIRADRI® 860/861 Self–Adhered Waterproofing Membrane, published by Nicolon Mirafi Group, Norcross, Georgia.

PDS–WIP1/2–1097, MiraDri WIP100 200 product description, published by TC MiraDRI, Norcross, Georgia.

QuickDRAIN Product Data Sheet, published by MiraDRi Moisture Proction Products, Norcross, Georgia, 01/98.

ROLL VENT 2 product brochure, published by Benjamin Obdyke Incorporated, printed 1/97.

ROLL®VENT Attic Ventilation System product brochure published by Benjamin Obdyke Incorporated, 10/97.

Spec–Data sheet of MIRADRI® Waterproofing System, published by Nicolon/Mirafi Group, Aug. 1994.

* cited by examiner

SUBTERRANEAN DRAIN ASSEMBLY

IMPROVED SUBTERRANEAN DRAIN ASSEMBLY

This application claims priority to, and incorporates herein by reference, U.S. provisional patent application Ser. No. 60/107,496, filed Nov. 6, 1998.

FIELD OF THE INVENTION

The present invention relates generally to the field of drain assemblies for draining water away from subterranean foundation walls or other subterranean construction surfaces.

BACKGROUND OF THE INVENTION

Proper drainage is an important consideration in the design and construction of subterranean foundations. In the absence of proper drainage, water can penetrate into the structures through tiny cracks or other openings, causing severe damage or leakage.

The problem of proper drainage has historically been addressed by guiding water away from the structure through a "French drain," a perforated horizontal drain pipe that extends along the bottom of the foundation. The perforated drain pipe is surrounded by gravel to prevent it from being crushed by the surrounding soil and to prevent soil from entering the drain pipe through the openings. Water from the soil seeps into the drain pipe, and is carried away.

As described in U.S. Pat. No. 4,840,515 to James S. Freese, thin drainage panels can be also be used in conjunction with French drains to help collect water in the vicinity of the foundation. Each drainage panel includes a sheet-like base and a filter media separated from the base by a plurality of dimples or projections that extend from the base. The resulting structure is a thin panel with a hollow interior between the base and the filter media. The panel is placed against the outside wall of a foundation, with the filter media facing outwards, and with the bottom of the panel terminating at a French drain. Soil is then back-filled against the foundation and panel, sandwiching the panel between the soil and the vertical foundation wall. Water from the soil penetrates into the panel through the water-permeable filter material, and trickles downward through the panel and into the French drain.

While drainage panels such as those disclosed in the Freese patent have proven useful, they can still be further improved. Most notably, drainage panels in the prior art are designed primarily to protect the vertical wall of the foundation, without providing adequate protection for the horizontal surface of the foundation's footing and without protecting the cold joint that exists where the vertical foundation wall meets the horizontal foundation footing. As a result, water can impregnate the cold joint, causing damage to the foundation. To the extent prior art panels can be used to cover both the vertical foundation wall and the horizontal foundation footing, they are difficult to bend to conform to the intersection of the foundation and the footing, where the foundation meets the footing usually at a 90 degree angle.

In addition, prior art drainage panels are typically used in conjunction with, rather than in place of, a French drain system. This requires that the lower edge of the drainage panel be connected into a French drain system along the entire length of the foundation wall, complicating the installation and increasing costs.

In view of these disadvantages with prior art drainage systems, it is an object of the present invention to provide a subterranean drainage system that does away with the need for a common French drain system, without the need for any gravel or perforated pipe. A further object of the present invention is to provide a subterranean drainage system that can be easily installed to protect and conform closely to both the vertical outer surface of a foundation wall and the horizontal upper surface of the foundation footing, while protecting the cold joint between the foundation and the footing. Finally, it is a further object of the invention to provide a drainage system in which the panel provides efficient drainage of water along the entire length of a foundation wall, and can be readily connected into a standard drain pipe at any desired point to drain water away from the panel and the foundation.

SUMMARY OF THE INVENTION

These and a number of additional objectives are satisfied by the present invention. In a basic aspect, the invention comprises an improved drainage panel that comprises a base in the form of a flexible sheet of plastic or other similar material, the base having an inner surface, an outer surface, a top edge, a bottom edge, a first side edge and a second side edge. A hinge extends along a line between the first and second side edges, allowing the base to be folded along that line. A plurality of members project from the inner surface of the base and a sheet of filter media is supported by the members in spaced-apart relation to the base.

The hinge in the base allows the entire panel to be folded to a desired angle along a horizontal line between the first and second side edges, whereby the panel can easily be folded to conform to the intersection of the vertical foundation wall and the horizontal footing. When installed, the lower portion of the panel (i.e., the portion between the hinge and the bottom edge of the panel) rests atop the horizontal footing, while the upper portion of the panel (i.e., the portion between the hinge and the top edge of the panel) is positioned against the outer surface of the vertical foundation wall. The panel, therefore, provides a continuous, seamless cover for both the vertical foundation wall and the horizontal footing, protecting the cold joint that exists at their intersection.

Moreover, the portion of the panel that rests atop the horizontal footing provides a horizontal fluid flow chamber for water collected in the panel, thereby completely avoiding the need for a French drain system. Water that trickles down through the panel collects in the horizontally disposed lower portion of the panel and flows through that portion of the panel to a drain pipe, where it is drained away from the foundation. In one embodiment, to provide increased fluid flow capability in the lower portion of the pane, the members in the lower portion of the panel are relatively long (preferably about 1 inch) as compared to the members in the upper portion of the panel. In particular, the lower portion of the panel has a sufficient profile such that substantially all of the fluid collected in the panel can flow through the lower portion of the panel to a collection point, without being forced back into the soil through the filter media by hydrostatic or other forces.

In another embodiment, the invention further comprises a connector assembly that is attached to the panel at a desired point and that allows the panel to be connected into a standard drain pipe to transport water away from the foundation.

The panel of the present invention is not necessarily intended to cover the entire surface of the vertical foundation wall. Instead, it is typically used to cover the horizontal foundation footing, the lower portion of the vertical foundation wall (for example, about 10 inches above the horizontal footing) and the junction between the footing and the vertical foundation wall. The remainder of the vertical foundation wall that extends above the top of the unit is covered by a standard drainage panel (such as that disclosed in the above-referenced Freese patent), which is connected to the top edge of the unit along its entire length. The panel is preferably provided in the form of a long roll, which can be rolled along the length of the foundation, covering the footing, the intersection of the footing and the vertical foundation wall, and the lower portion of the vertical foundation wall.

The system provides several benefits over prior art designs. By providing a hinge in the base member, the panel can be easily folded along its entire width to cover both the vertical foundation wall and the horizontal footing with a continuous section of panel, protecting the cold joint between the foundation wall and the footing. Providing relatively longer members in the lower portion of the pad creates a relatively high profile horizontal fluid flow region within the panel, which increases the throughput capacity and efficiency of fluid flow through the panel as compared to a similar length of panel oriented vertically. It also does away with the need for providing a French drain assembly along the entire length of the foundation footing, since the lower portion of the panel provides sufficient fluid flow capacity along the entire length of the foundation.

DESCRIPTION OF PREFERRED EMBODIMENTS

Figure 1:
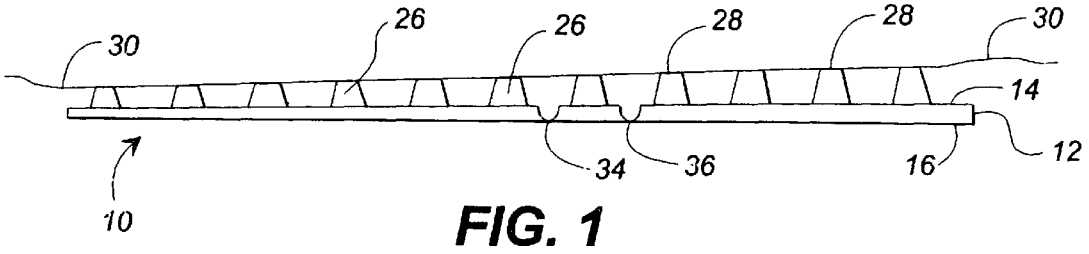
FIG. 1 of the drawing is a side view of an improved drainage panel in accordance with the present invention.
Figure 2:
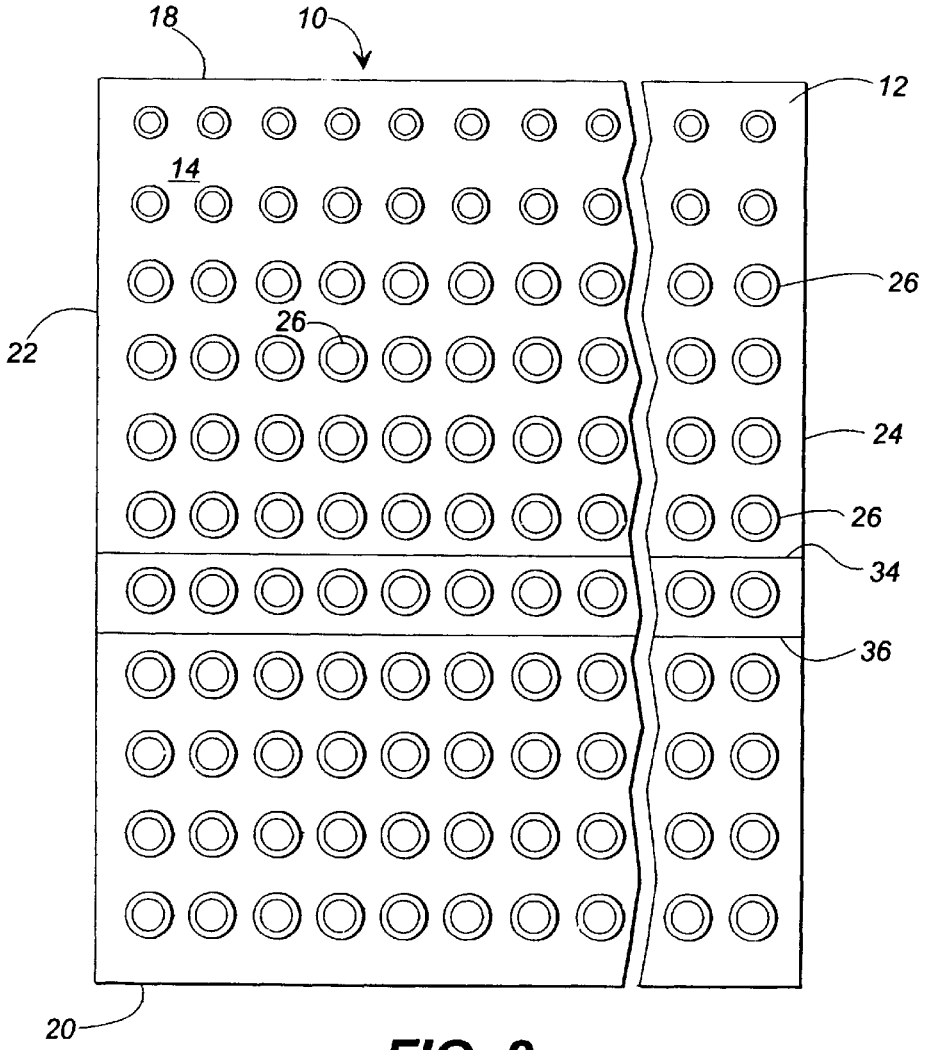
FIG. 2 of the drawing is a plan view of the panel of FIG. 1, with the filter media removed to show the members projecting from the inner surface of the base.
Figure 3:
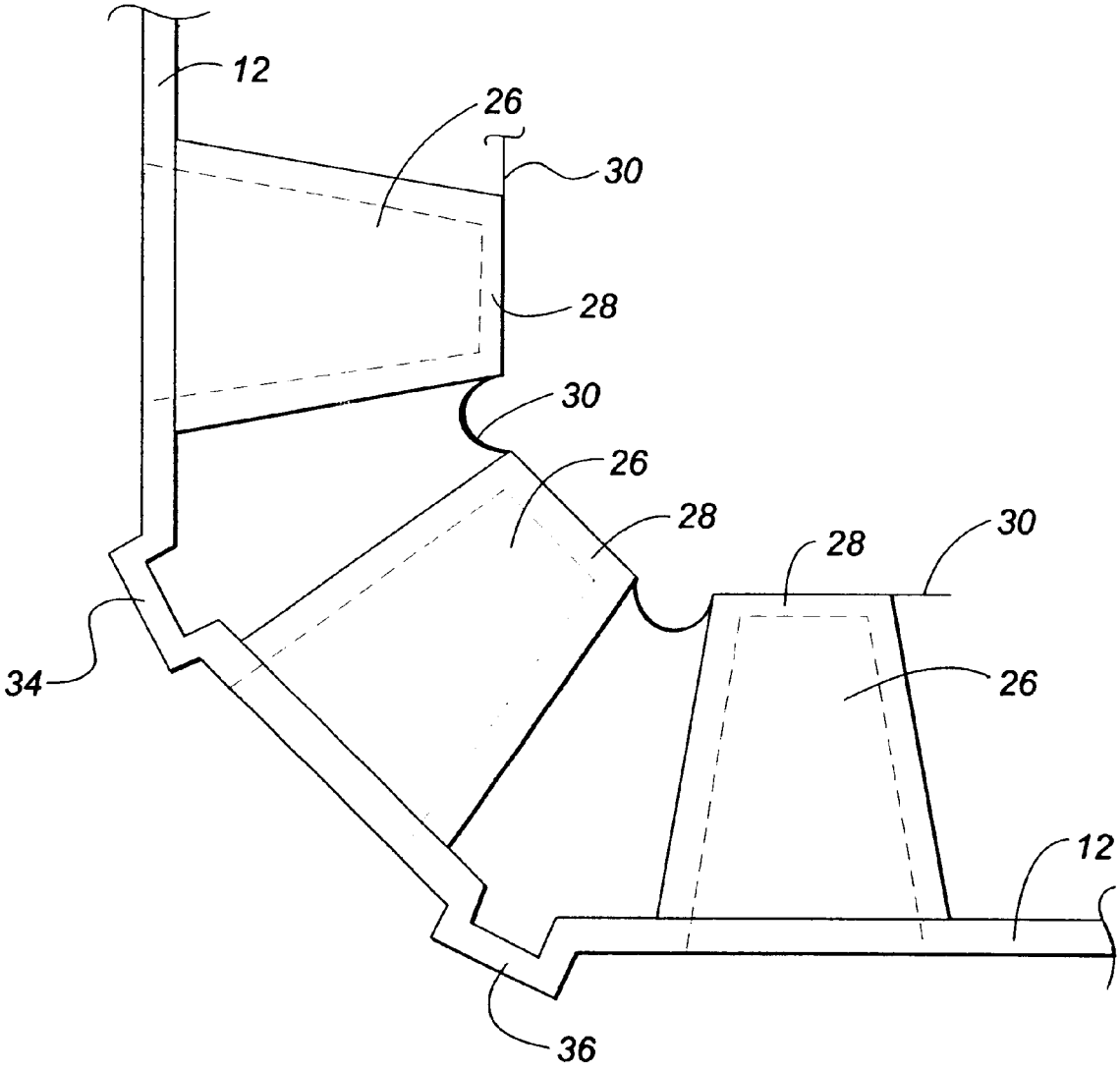
FIG. 3 of the drawing is an enlarged side view of the hinge region of the drain assembly of FIGS. 2 and 3, with the base folded to 90 degrees.

The details of various preferred embodiments of the present invention are shown in FIGS. 1–6 of the drawing. Turning first to FIGS. 1–3, the details of an improved panel assembly 10 are shown. As shown in FIGS. 1 and 2, the panel assembly 10 comprises a flexible sheet-like base 12 having an inner surface 14, an outer surface 16, a top edge 18, a bottom edge 20, a first side edge 22 and a second side edge 24. A plurality of members 26 project from the inner surface 14 of the base 12, each member 26 terminating in a distal end 28. The members are preferably arranged in uniformly spaced rows (extending between the first side edge 22 of the base and the second side edge 24) and columns (extending between the top edge 18 of the base and the bottom edge 20).

Although not shown to scale in FIG. 2, the base 12 (and thus the entire panel 10) is preferably about 50 feet wide, measured between the first side edge 22 and the second side edge 24, and about 16 inches tall, measured between the top edge 18 and the bottom edge 24, and is provided to users in the form of a long roll that can be unrolled along the foundation to install the panel. Providing the panel in a long roll reduces or avoids the need to join panels side-by-side to cover the foundation wall, thereby reducing or avoiding vertical seams in the coverage of the foundation wall. A sheet of filter media 30 is supported by the projecting members 26 in spaced-apart relation to the inner surface 14 of the base member 12, the base member 12 and the filter media 30 together defining a fluid-flow region inside the panel 10.

The base 12 is thermoformed of materials having characteristics suitable for the end product use. It is preferably a polymeric material, such as a high impact polystyrene, although persons of skill in the art will recognize that other materials may also be used. Polystyrene may be used when its characteristics of high impact resistance and resistance to creep are desirable. It absorbs and gives up heat rapidly so that fast production is possible. Its chemical properties must be considered in view of the environment of the end use. PVC (polyvinyl chloride) and high density polyethylene plastics may also be used. The latter has good chemical resistance but poor creep resistance while the former is not quite as chemical resistant as high impact polystyrene but has better creep resistance than polyethylene. The flat portions of the base are between 30 and 60 mils thick, depending on the compressive strength requirements for a particular application and panel design.

The members 26 may be molded directly from the base 12, which results in each member being hollow with an opening onto the outer surface 16 of the base 12, as shown in FIG. 3. The distal end 28 of each member 26 is preferably flat. A frustoconical configuration provides clean uninterrupted fluid flow paths within the panel 10 and good adhesion zones for the filter media 30. The use of hollow projections also allows for male-female union of the projections of different drain panels, whereby individual panels can be connected to one another in side-by-side or top-to-bottom relation by linking the projections of one panel with the recesses inside the projections of an adjacent panel.

The filter media 30 can be any suitable permeable sheet material, such as those already known for use in drainage panels. By way of example, the filter media can be a non-woven, needle punched polypropylene or other similar material. Other materials such as spunbonded or woven materials can also be used. In a preferred embodiment, the filter media 30 is a non-woven polypropylene geotextile fabric such as that sold by MiraDri Moisture Protection Products of Norcross, Georgia, under the product name 160 N. The filter media 30 is attached to the free distal ends 28 of the members 26 using any of a variety of techniques known in the art. In one embodiment, the filter media 30 is attached to the members 26 by a hot-melt adhesive. In another embodiment, the distal ends 28 of the members are heated, causing the filter media 30 to fuse to the members when it contacts them. The filter fabric allows water to pass freely into the interior of the panel 10, while preventing soil from entering the flow channels inside the panel.

The base 12 further comprises at least one hinge 34 that extends along a line between the first and second side edges. Preferably, it includes first and second parallel hinges 34 and 36 separated by at least one (and preferably one) row of members. As used herein, the term hinge includes any structure that extends on a line between the first and second side edges of the base, to facilitate folding the base along that line. For instance, it can be a line of reduced thickness in the base, or a groove or a channel with a unshaped or square-shaped cross-section that extends along the desired folding line.

Each hinge 34 and/or 36 extends along a horizontal line between the first side edge 22 and the second side edge 24 of the base 12 to facilitate folding the panel. This allows the panel to be bent or folded such that the upper portion (i.e., the portion above the hinge) can be placed against the outer wall of a vertical foundation wall, with the lower portion (i.e., the portion below the hinge) resting atop the horiztonal foundation footing.

The row of members 26 between the hinges 34 and 36 prevents the filter media 30 from protruding unduly into the interior of the drainage panel when the panel is folded and installed, as shown in FIG. 3. The filter media 30 may be attached to the base as a single continuous piece, or may be attached as two separate pieces that overlap the hinges to further prevent the filter media 30 from intruding into the panel when the panel is folded. The filter media 30 should extend beyond the lower edge of the panel a sufficient distance to allow the media to be folded over the end of the panel and tucked under the panel when the panel is installed. The members 26 should be positioned relative to the hinge or hinges such that members in adjacent rows will not contact one another to prevent folding of the base 12 along the hinge or hinges. Of course, persons of ordinary skill in the art will understand that the number of rows and columns of members 26 can vary depending on the size or shape or spacing of the members, as can the specific location of the hinge or hinges.

In one preferred embodiment, the members 26 are arranged in straight rows and columns forming a repeating square pattern of members 26 across the inner surface 14 of the base 12, with adjacent rows and adjacent columns being about one and one-half inches apart, measured from the center point of adjacent members. The members in a given row have a uniform height.

In a particularly preferred emodiment having two hinges, there are four rows of members below the first (i.e., the lower-most) hinge 34. There is a fifth row of projections between the first hinge 34 and the second (i.e. the upper-most) hinge 36, with six rows of members between the second hinge and the upper edge of the panel. The members in the first eight rows of members from the bottom of the panel are approximately one-inch tall (measured from the inner surface of the base to the flat distal end of the members). The members in the ninth, tenth and eleventh rows have heights of approximately ¾, ⅝ and ½ inch, respectively.

While these specific heights and spacings have been found to be particularly suitable by the inventors for most applications, persons of skill in the art will recognize that projections of different heights or shapes or spacing, arranged in different configurations on the base, may also be used, as long as the projections provide sufficient structural integrity to prevent the panel from collapsing under the force of the surrounding soil, and as long as the projections provide sufficient gap between the base 12 and the filter media 30 to ensure adequate fluid flow within the panel 10. In particular, the lower portion of the panel 10 should have sufficient separation between the inner surface of the base 12 and the inner surface of the filter media 30, such that when the panel is installed atop a foundation footing, substantially all of the fluid collected in the panel can flow through the lower portion of the panel to a collection point, without being forced back into the soil through the filter media.

Figure 4:
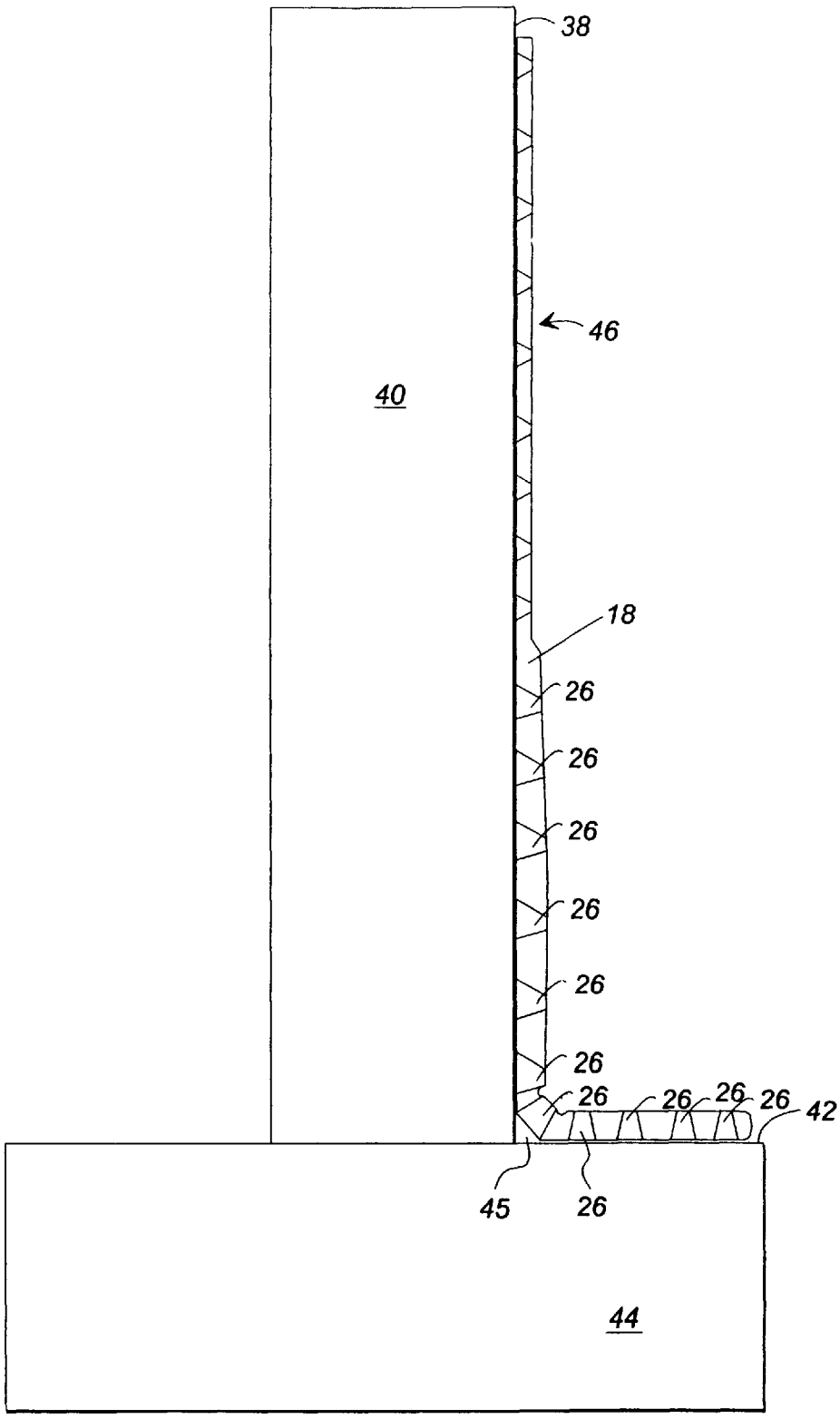
FIG. 4 of the drawing is a side view of a subterranean foundation showing the drain panel of FIG. 1 installed, with a standard drain panel installed on top of it.

As noted above, the hinge 34 or hinges 34 and 36 allow the base 12 (and thus, the entire panel 10) to be folded along a horizontal axis to any desired angle, usually 90 degrees. As shown in FIG. 4, this allows the outer surface 16 of the panel to be positioned against the outer surface 38 of a vertical foundation wall 40, and against the upper surface 42 of the foundation's footing 44. A Standard fillet 45 is used to support the base 12 between the two hinges, where the base is at a 45 degree angle to both the footing and the foundation wall.

A plurality of the panels 10 may be joined together in side-by-side fashion along the length of a foundation wall, by overlapping the side edges of adjacent panel rolls, and joining the overlapping projections in male-female union to secure the panels to one another. Similarly, a plurality of standard drainage panels 46 may be attached to the top of the panels 10 in a similar manner, to cover the surface 38 of the foundation wall 40 above the panels 10. Water enters the panels 46 and 10 from the surrounding soil and trickles downward to the bottom of the panel 10. The water then runs along the footing of the foundation inside the panel 10, toward a desired collection point.

As noted above, the improved drainage panel provides for the efficient collection of water along the entire length of the foundation wall. However, while the panel avoids the need for a French drain along the entire length of the foundation wall, the water that is collected in the panel must still be drained away from the foundation in some way, for instance, to a drainage system or storm sewer. Therefore, in one embodiment of the present invention, the system includes a connector assembly that is connected to the panel at a chosen location (such as a corner of the foundation or along a side of the foundation). The water collected in the panel flows through the panel to the connection assembly and into a standard drain pipe that is connected to the connector assembly.

Figure 5:
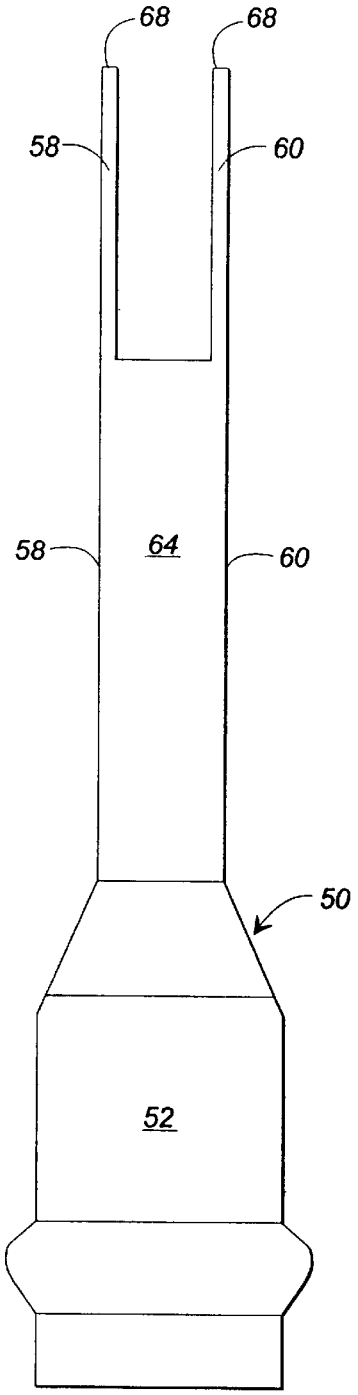
FIG. 5 of the drawing is a side view of a connector assembly for the drain panel to a drain pipe.
Figure 6:
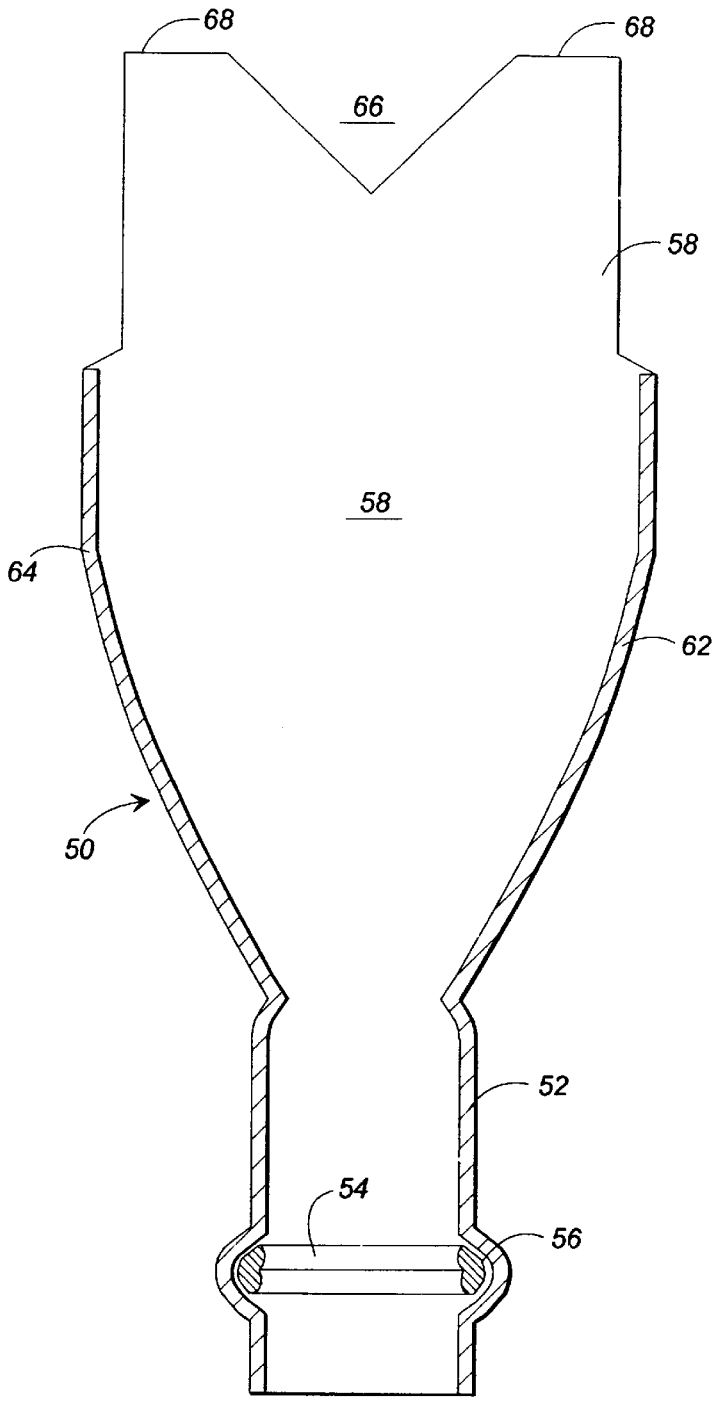
FIG. 6 of the drawing is a cross-sectional top view of the connector assembly of FIG. 5, taken along line 6—6 of FIG. 5.

In one embodiment, shown in FIGS. 5 and 6, the connector assembly 50 comprises a cylindrical collar 52, one end of which is adapted to receive the end of a standard drain pipe. An O-ring seal 54, preferably of rubber or other suitable polymeric material, is disposed near the end of the collar 52 into which the drain pipe is inserted, to provide a seal between the inner surface of the collar 52 and the outer surface of the drain pipe. The O-ring 54 is held in place within a groove or recess 56 formed in the interior of the collar. The connector assembly 50 further comprises a pair of flat plates 58 and 60 that extend outwardly from the end of the collar opposite where the drain pipe is inserted, in parallel and spaced apart relation to one another. The plates 58 and 60 are spaced apart from one another a distance (measured between the adjacent inner surfaces of the plates) that is roughly equal to the thickness of the panel at a given location, such that that connector assembly 50 can be installed onto the panel 10 with the panel sandwiched between the two parallel plates 58 and 60. The adjacent lateral edges of the parallel plates are connected by side walls 62 and 64. There are no side walls between the portions of the parallel plates that are intended to cover and sandwich the drain panel, since the presence of side walls would prevent the plates from being slipped over the panel. A notch 66, preferably in the form of a two-sided notch with the sides at a 90 degree angle from one another and at a 45 degree angle to the axis of the collar, is cut into the leading edge 68 of the connector. This notch is adapted to receive the corner of the vertical foundation wall when the connector is installed at the corner of the foundation, stablizing the connector relative to the foundation walls and ensuring that the connector can be placed fully onto the panel without being limited by the presence of the foundation walls.

The connector assembly 50 is preferably made of molded polyvinyl chloride, approximately 7/32 to ¼ inch thick. In a preferred embodiment, the connector 50 is approximately 18 inches long from the exposed end of the collar 52 to the edge 68 and the flat plates 58 and 60 are approximately 10½ inches wide at their widest part. The collar 52 has an inner diameter of approximately 4½ inches, an outer diameter of approximately 5 inches, and a length of approximately 60 inches. The O-ring is positioned approximately 1¾ inches from the exposed end of the collar 52. The side walls 62 and 64 extend between the parallel plates 58 and 60 from the point where the plates join the collar, to a point approximately 4½ inches from the end 68 of the plates. The remaining 4½ inches of the plates are not joined by side walls, allowing the lower portion of the panel 10 to be slipped between the plates.

While the present invention has been described above by reference to various specific embodiments, it should be understood that the invention is not limited to those specific embodiments, and various modification and changes may be made to those embodiments without departing from the scope and spirit of the invention claimed below.

What is claimed is:

1. A drainage assembly for draining water from the vicinity of a subterranean construction surface, comprising:

a) a flexible sheet-like base having an inner surface, an outer surface, a top side edge, a bottom side edge, a first side edge and a second side edge;

b) a plurality of members that project from the inner surface of the base; each member terminating in a distal end;

c) at least one hinge formed in the base along a line extending between the first and second edges of the base;

d) a sheet of filter media supported by the projecting members in spaced-apart relation to the inner surface of the base member, the base and filter media together forming a hollow panel having an upper portion between the upper edge of the panel and the hinge and a lower portion between the lower edge of the panel and the hinge;

e) a connector assembly for connecting the panel to a drain pipe wherein the connector assembly comprises:

i) a cylindrical collar, a first end of which is adapted to receive the end of a standard drain pipe;

ii) first and second flat plates that extend outwardly from the end of the collar opposite the first end, in parallel, spaced apart relation to one another, the plates spaced apart from one another by a distance, as measured between the adjacent surfaces of the plates, that is approximately equal to the thickness of the panel at a given location, such that that connector assembly can be installed onto the panel at the given location with the panel sandwiched between the two parallel plates.

2. A drainage assembly for draining water from the vicinity of a subterranean construction surface, comprising:

a) a flexible sheet-like base having an inner surface, an outer surface, a top side edge, a bottom side edge, a first side edge and a second side edge;

b) a plurality of members that project from the inner surface of the base; each member terminating in a distal end;

c) two hinges formed in the base along parallel lines extending between the first and second side edges of the base, the two hinges separated by one row of projecting members;

d) a sheet of filter media supported by the projecting members in spaced-apart relation to the inner surface of the base member, the base and filter media together forming a hollow panel having, an upper portion between the upper edge of the panel and the hinge and a lower portion between the lower edge of the panel and the hinge; and e) a connector assembly for connecting the panel to a drain pipe, the connector assembly comprising:

i) a cylindrical collar, a first end of which is adapted to receive the end of a standard drain pipe; and ii) first and second flat plates that extend outwardly from the end of the collar opposite the first end, in parallel, spaced apart relation to one another, the plates spaced apart from one another by a distance, as measured between the adjacent surfaces of the plates, that is approximately equal to the thickness of the panel at a given location, such that that connector assembly can be installed onto the panel at the given location with the panel sandwiched between the two parallel plates.

* * * * *